US007735985B2

(12) United States Patent
Ward et al.

(10) Patent No.: US 7,735,985 B2
(45) Date of Patent: Jun. 15, 2010

(54) CARTRIDGE HOLDER

(75) Inventors: Jefferson P. Ward, Brush Prairie, WA (US); Bruce A. McFadden, Vancouver, WA (US); David B. Novak, Philomath, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 460 days.

(21) Appl. No.: 11/862,620

(22) Filed: Sep. 27, 2007

(65) Prior Publication Data

US 2009/0085992 A1 Apr. 2, 2009

(51) Int. Cl.
*B41J 2/175* (2006.01)

(52) U.S. Cl. ..... 347/86; 347/84; 347/50

(58) Field of Classification Search ..... 347/84–86, 347/49–50

See application file for complete search history.

(56) References Cited

U.S. PATENT DOCUMENTS 5,138,344 A 8/1992 Ujita
5,392,063 A 2/1995 Rhoads
6,371,586 B1 4/2002 Saruta
7,275,810 B2 * 10/2007 Shinada et al. ..... 347/50
7,686,441 B2 * 3/2010 Hashii et al. ..... 347/86

FOREIGN PATENT DOCUMENTS

JP 03227650 A 10/1991
JP 2006082567 A 3/2006

OTHER PUBLICATIONS

Armor, New Armor Solution for Canon Pixma,—descriptive web site materials, www.armor.fr, Sep. 26, 2007.
Druckerchannel, Descriptive website materials, www.druckerchannel.de, Nov. 8, 2006.
Druckerchannel, Descriptive website materials, www.druckerchannel.de, Feb. 16, 2007.
International Search Report dated Jan. 30, 2009 for International Application No. PCT/US2008/077390, filing Sep. 23, 2008.

* cited by examiner

*Primary Examiner*—Ellen Kim

(57) ABSTRACT

In one embodiment a cartridge holder includes: a body having a plurality of bays therein for holding a cartridge and each bay having an electrical connector associated therewith for connecting to a chip; an adapter removably attachable to the body at a bay, the adapter having a site for a chip at a location where a chip installed at the chip site is connected to a connector in the bay when the adapter is attached to the body; and each bay configured to hold: without an adapter attached to the body at the bay, a first cartridge having a first shape and a chip thereon, and, with the adapter attached to the body at the bay, a second cartridge having a second shape different from the first shape and the second cartridge not having a chip thereon.

18 Claims, 8 Drawing Sheets

CARTRIDGE HOLDER

BACKGROUND

Many types of printers use cartridges to hold marking material such as ink or toner. These cartridges are known by a variety of names including ink cartridges, inkjet cartridges, print cartridges, pens, or toner cartridges. Multiple cartridges of various colors or marking material type may exist in a single printer. So called "chipped" cartridges carry an integrated circuit chip which connects to the printer controller through connections in the carriage. The chip may identify various features of the cartridge to the printer in which the cartridge is installed. It may be a disadvantage when a printer designed for using chipped cartridges cannot also use non-chipped cartridges.

DRAWINGS

Figure 1:
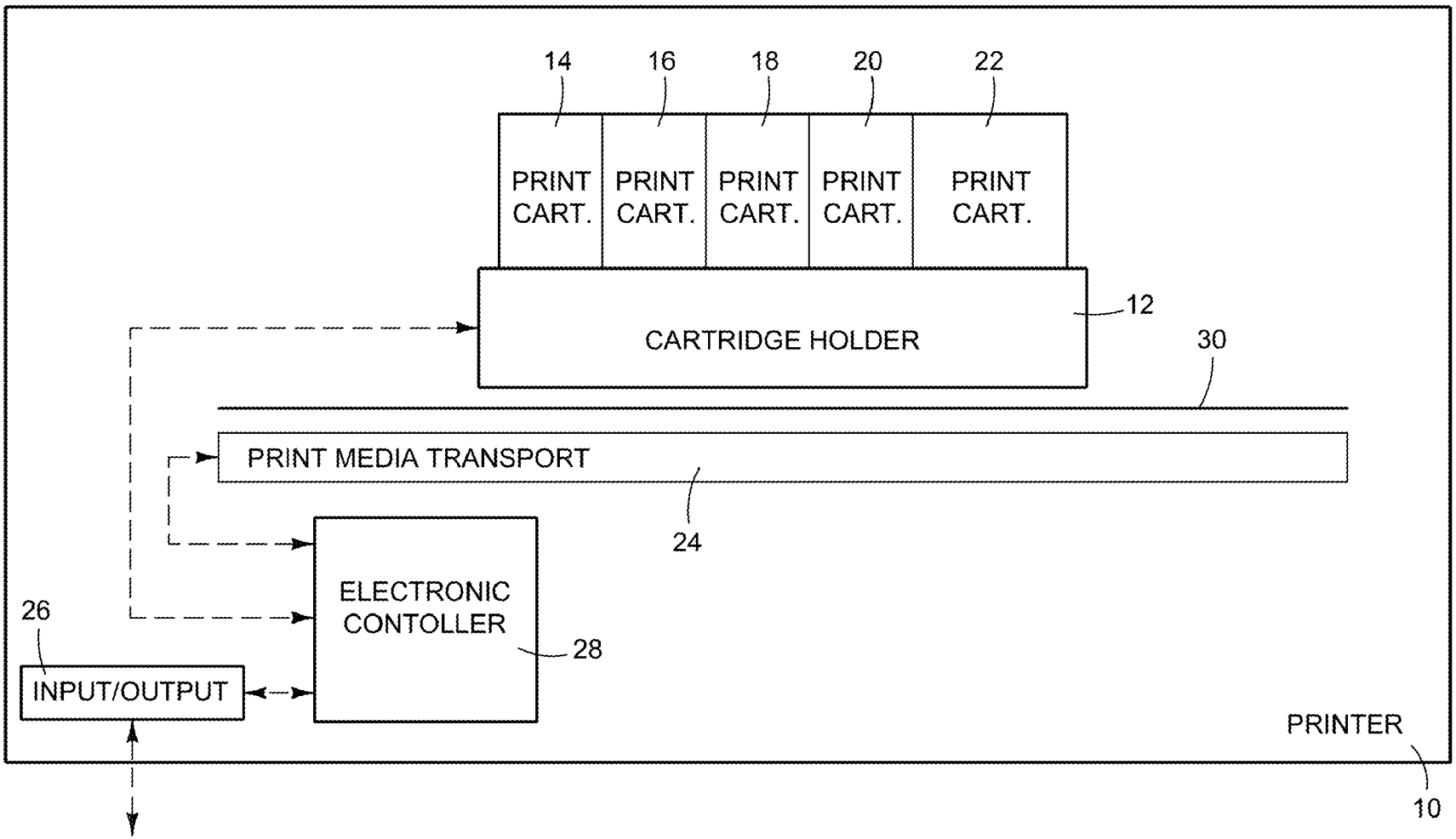
FIG. 1 is a block diagram illustrating an inkjet printer.

Part number lead lines with arrows are sometimes used in the drawings to designate an assembly or another part for which multiple features or elements are described.

DESCRIPTION

Embodiments of the invention were developed in an effort to allow an inkjet printer designed for using chipped ink cartridges to also use non-chipped ink cartridges. Exemplary embodiments of the invention will be described, therefore, with reference to an inkjet printer. The invention, however, is not limited to use with inkjet printers or ink cartridges. Embodiments of the invention may be implemented in other printers or other processing devices which use replaceable cartridges. Hence, the following description should not be construed to limit the scope of the invention, which is defined in the claims that follow the description.

FIG. 1 is a block diagram illustrating an inkjet printer 10 in which embodiments of the invention may be implemented. Referring to FIG. 1, printer 10 includes print cartridges 14, 16, 18, 20, 22, a cartridge holder 12, a print media transport mechanism 24, an input/output device 26, and an electronic printer controller 28 connected to each of the operative components of printer 10. Each print cartridge 14-22 may include one or more ink holding chambers and a printhead (not shown). An inkjet printhead is typically a small electromechanical assembly that contains an array of miniature thermal, piezoelectric or other devices that are energized or activated to eject small droplets of ink out of an associated array of nozzles. A typical thermal inkjet printhead, for example, includes a nozzle plate arrayed with ink ejection nozzles and firing resistors formed on an integrated circuit chip positioned behind the ink ejection nozzles. The ink ejection nozzles are usually arrayed in columns along the nozzle plate. In operation, when controller 28 selectively energizes a firing resistor in the printhead a vapor bubble forms in the ink vaporization chamber, ejecting a drop of ink through a nozzle on to the print media 30.

Print cartridges 14-22 may include a series of stationary cartridges or printheads that span the width of print media 30. Alternatively, cartridges 14-22 may include one or more cartridges that scan back and forth on a movable holder (called a carriage) 12 across the width of media 30. Other cartridge configurations are possible. A movable carriage 12 for cartridges 14-22 may include a guide along which the carriage moves, a drive motor, and a belt and pulley system that moves the carriage along the guide. Media transport 24 advances print media 30 lengthwise past cartridges 14-22 and the associated printheads. For stationary cartridges 14-22, media transport 24 may advance media 30 continuously past cartridges 14-22. For scanning cartridges 14-22, media transport 24 may advance media 30 incrementally past cartridges 14-22 and associated printheads, stopping as each swath is printed and then advancing media 30 for printing the next swath.

Controller 28 communicates with external devices through input/output device 26, including receiving print data for inkjet imaging. The presence of an input/output device 26, however, does not preclude the operation of printer 10 as a stand alone unit. Controller 28 controls the movement of carriage 12 and media transport 24. Controller 28 is electrically connected to cartridges 14-22 to selectively energize the firing resistors, for example, to eject ink drops on to media 30 in a print zone. By coordinating the relative position of cartridges 14-22 with media 30 and the ejection of ink drops, controller 28 produces the desired image on media 30.

Figure 2:
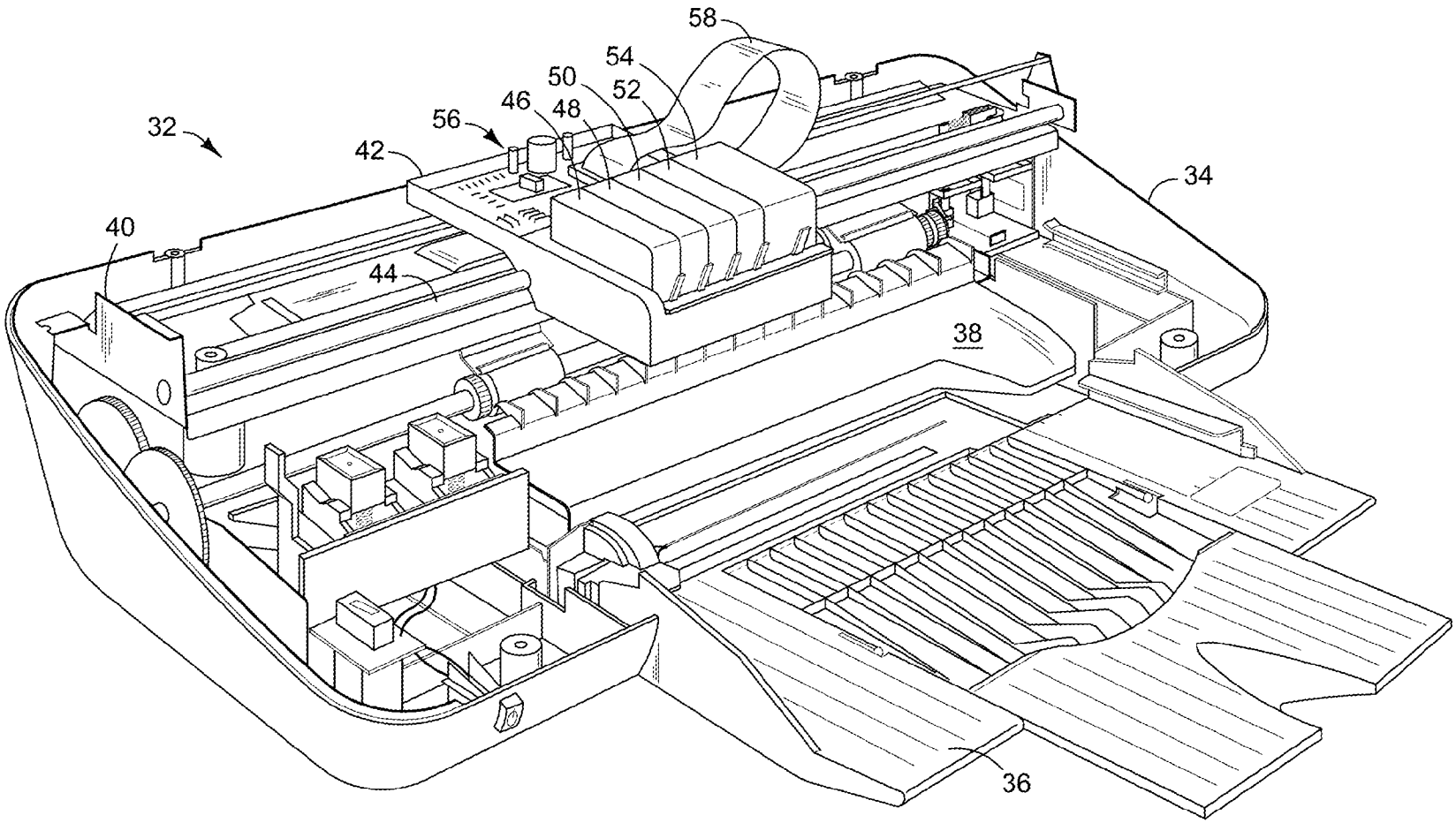
FIG. 2 is a perspective view of an inkjet printer.

FIG. 2 is perspective view, of an inkjet printer 32, such as might be used for printer 10 of FIG. 1. Referring to FIG. 2, printer 32 includes a cover (not shown) and a housing 34. The cover is removed in FIG. 2 to expose the operative components of printer 32. A sheet media tray 36 is positioned at the bottom of printer 32 along an opening in housing 34. Paper or other print media sheets are stacked in tray 36 for input to printer 32 and printed sheets are output back over tray 36. A supporting surface 38 helps suspend the trailing edge of the printed sheets over tray 36. Printer 32 includes a chassis 40 that supports the operative components of printer 32. Chassis 40 represents generally those parts of housing 34 along with other structurally stable elements in printer 32 that support the operative components of printer 32. A movable carriage 42 is driven back and forth along a guide rail 44 mounted to chassis 40. Any suitable drive mechanism may be used to move carriage 42. A reversing motor (not shown) coupled to carriage 42 through a belt and pulley system (not shown), for example, is one drive mechanism commonly used in inkjet printers.

Figure 3:
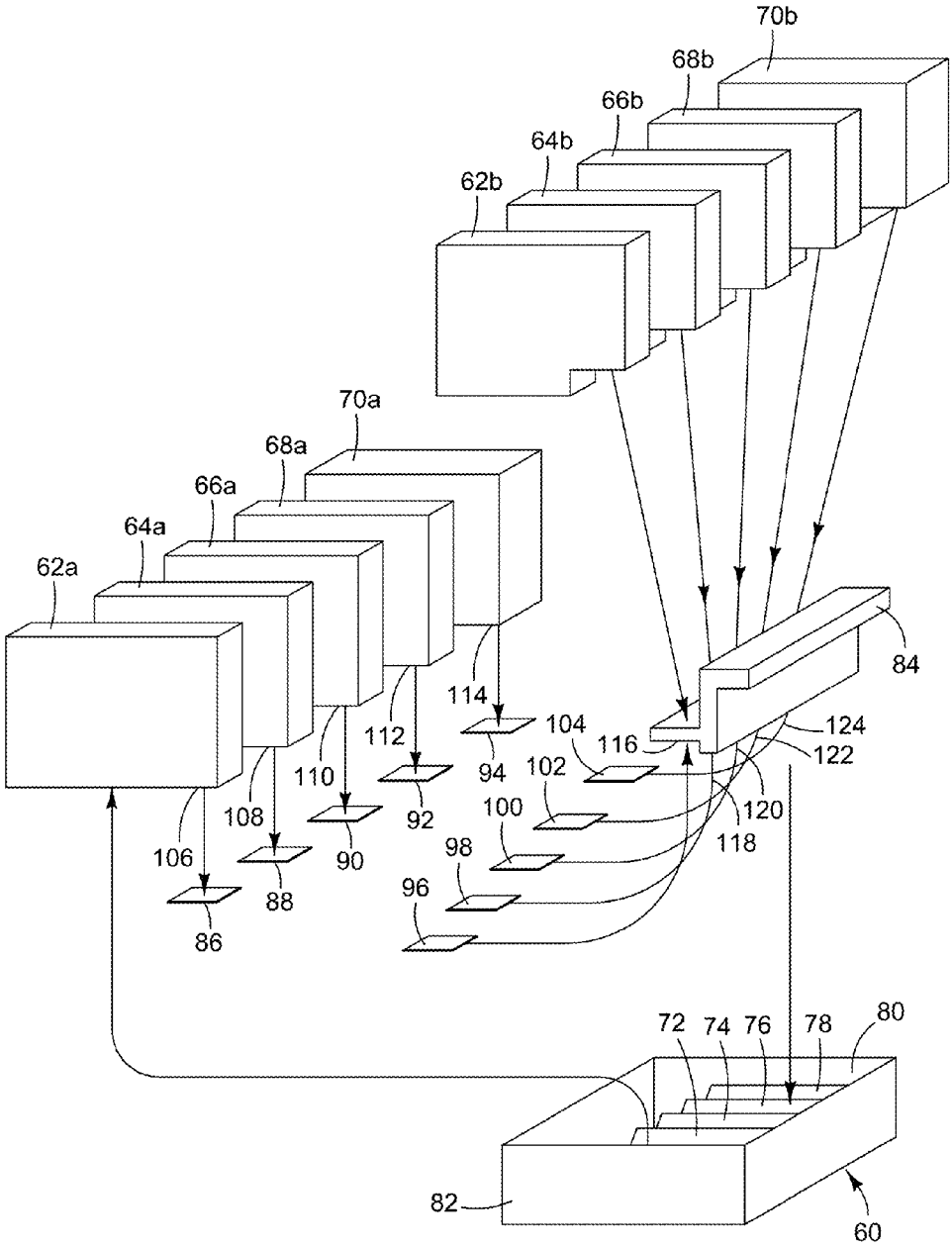
FIG. 3 is a perspective view illustrating one embodiment of a cartridge holder, such as might be used in the printers of FIGS. 1 and 2, in which a single adapter is used for installing a set of non-chipped print cartridges.

Print cartridges 46, 48, 50, 52 and 54 are held in carriage 42. Cartridges 46-54 are positioned along a media path such that each sheet of print media passes directly under cartridges 46-54 at a print zone. As described above with reference to FIG. 1, the bottom of each cartridge 46-54 which faces the media sheet, includes an array of nozzles through which drops of ink are ejected onto the media sheet. Print cartridges 14-22 in FIG. 1 and print cartridges 46-54 in FIG. 2 represent chipped or non-chipped cartridges as described in detail below. An electronic printer controller 56 receives print data from a computer, scanner, digital camera or other image generating device. Also, controller 56 may itself generate print data, as well as store pre-programmed print data. Controller 56 controls the movement of carriage 42 back and forth across a media sheet (not shown) and the advance of the media sheet along a media path. Printer controller 56 is also electrically connected to ink cartridges 46-54 through, for example, a flexible ribbon cable 58. For printing, as carriage 42 carries cartridges 46-54 across the media sheet, printer controller 56 selectively activates ink ejection elements in cartridges 46-54 according to print data to eject ink drops through the nozzles onto the media sheet. By combining the movement of carriage 42 across the media sheet with the movement of the media sheet along the media path, controller 56 causes cartridges 46-54 to eject ink onto the media sheet to form the desired print image FIG. 3 is a perspective view illustrating one embodiment of a cartridge holder 60 such as might be used as holder 12 in FIG. 1 and in carriage 42 in FIG. 2. Referring to FIG. 3, holder 60 may be used to hold chipped cartridges 62*a*, 64*a*, 66*a*, 68*a* and 70*a* or non-chipped cartridges 62*b*, 64*b*, 66*b*, 68*b* and 70*b*. Each chipped cartridge 62*a*-70*a* is installed directly into a bay 72, 74, 76, 78 and 80 in a body 82 of holder 60. Each non-chipped cartridge 62*b*-70*b* is installed in a bay 72-80 using an adapter 84. Adapter 84 may be alternately inserted into body 82 for installing non-chipped cartridges 62*b*-70*b* and removed from body 82 for installing chipped cartridges 62*a*-70*a*. In the embodiment shown in FIG. 3, a single adapter 84 is used for installing all non-chipped cartridges 62*b*-70*b*. The shape of each non-chipped cartridge 62*b*-70*b* is modified relative to the shape of a chipped cartridge 62*a*-70*a* to fit properly into the corresponding bay 72-80 with adapter 84 installed in holder body 82. For example, in the embodiment shown in FIG. 3 in which the adapter 84 includes an L shaped piece that fits into the rear of body 82, each non-chipped cartridge 62*b*-70*b* is recessed and shortened, compared to a chipped cartridge, to fit into the corresponding bay 72-80 with adapter 84 installed in body 82.

A chip 86, 88, 90, 92 and 94 on each chipped cartridge 62*a*-70*a* is electronically connected to the printer controller through a set of electrical contacts (not shown) in bays 72-80 when cartridges 62*a*-70*a* are installed in holder body 82. A chip 96, 98, 100, 102 and 104 on adapter 84 at the location of each non-chipped cartridge 62*b*-70*b* is electronically connected to the printer controller through the electrical contacts in bays 72-80 when adapter 84 is installed in body 82. "Chip" as used in this document means an integrated or other electronic circuit that may be used to store information. Each chip 86-94 and 96-104 contains information that may be read and used by the controller in the operation of the printer, including for example the status of the cartridge (e.g., new or used), the amount of ink remaining in the cartridge, the color of the ink, or the type of ink. As discussed in more detail below with regard to FIGS. 5-6, a site 106, 108, 110, 112 and 114 on each chipped cartridge 62*a*-70*a* at the location of each chip 86-94 corresponds to the location of the electrical contacts in body 82. Similarly, a site 116, 118, 120, 122 and 124 on adapter 84 at the location of each chip 96-104 corresponds to the location of the electrical contacts in body 82. In one example application for a holder 60, when the ink or other marking material in a chipped print cartridge 62*a*-70*a* is depleted, the original chipped cartridge 62*a*-70*a* may be replaced with a non-chipped cartridge 62*b*-70*b* using adapter 84. Chips 96-104 on adapter 84 may include new chips installed on adapter 84 or used chips removed from the depleted chipped cartridges 62*a*-70*a* and re-installed on adapter 84.

Figure 4:
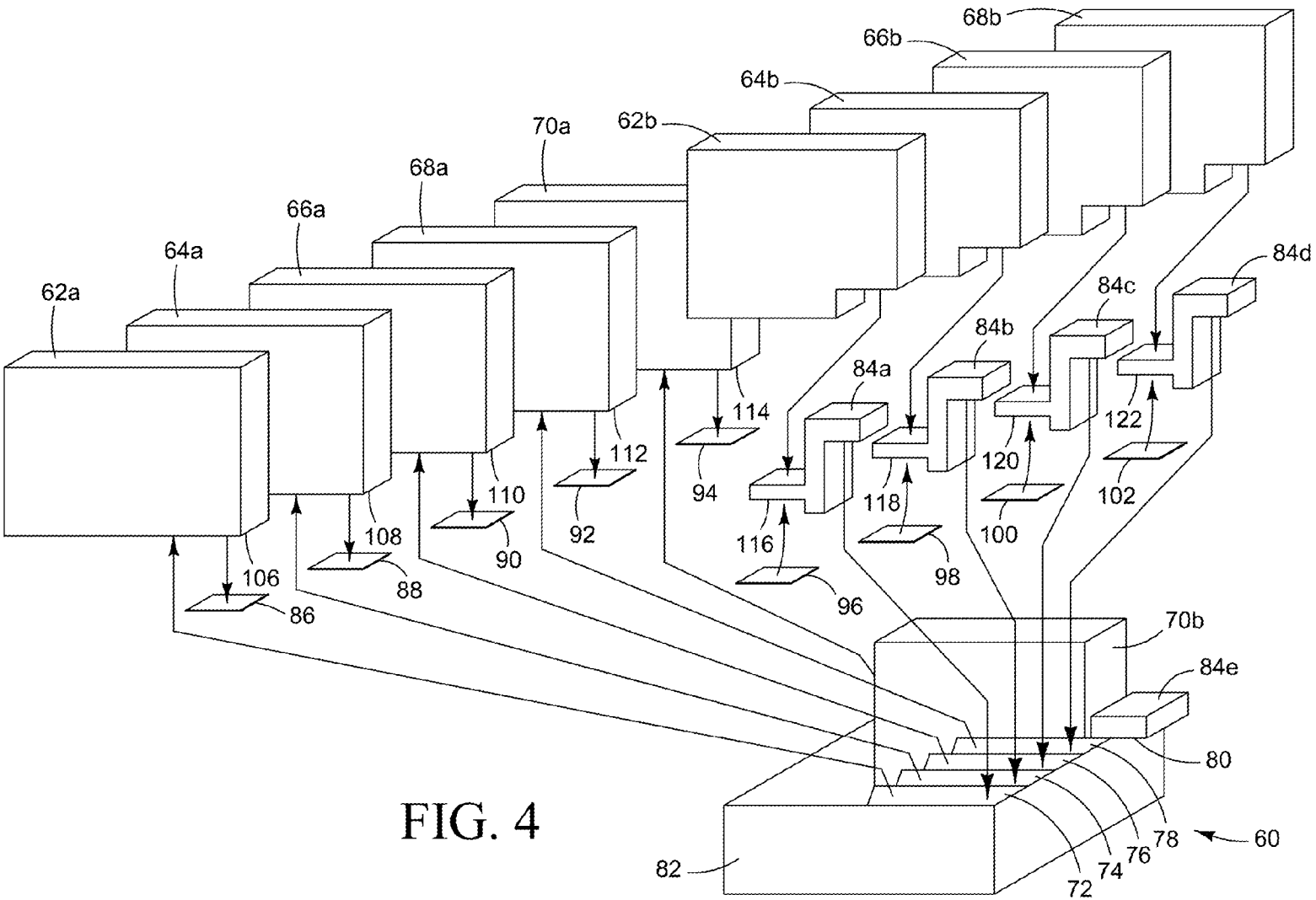
FIG. 4 is a perspective view illustrating another embodiment of a cartridge holder, such as might be used in the printers of FIGS. 1 and 2, in which an individual adapter is used for installing each non-chipped print cartridge.

In an alternative embodiment of holder 60 shown in FIG. 4, individual adapters 84*a*, 84*b*, 84*c*, 84*d* and 84*e* allow holder 60 to be used with chipped cartridges, non-chipped cartridges, or a combination of chipped cartridges and non-chipped cartridges. FIG. 4 shows a non-chipped cartridge 70*b* (corresponding to a larger, black ink cartridge) installed in bay 80 using adapter 84*e*. Individual adapters 84*a*-84*e* allow the replacement of depleted individual chipped cartridges with full non-chipped cartridges (and vice versa), as the individual cartridges are depleted of ink without regard to the fill level of other cartridges in holder 60. Other configurations for the adapter are possible. For example, a pair of adapters might be used in which one of the adapters corresponds to a non-chipped black ink cartridge and the other adapter corresponds to a set of non-chipped color ink cartridges.

Figure 5:
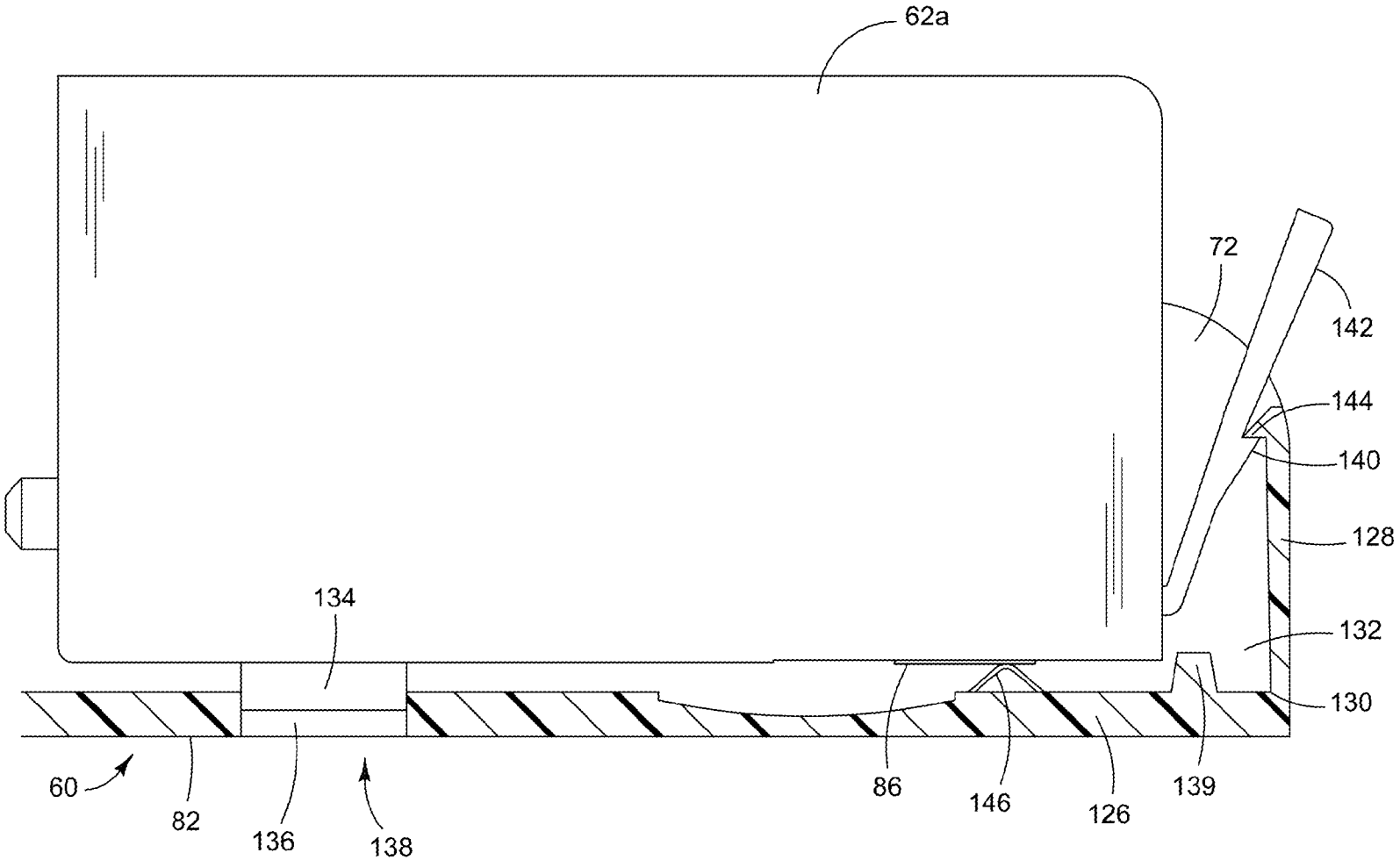
FIG. 5 is a partial side elevation section view showing one example of a conventional installation for a chipped print cartridge.
Figure 6:
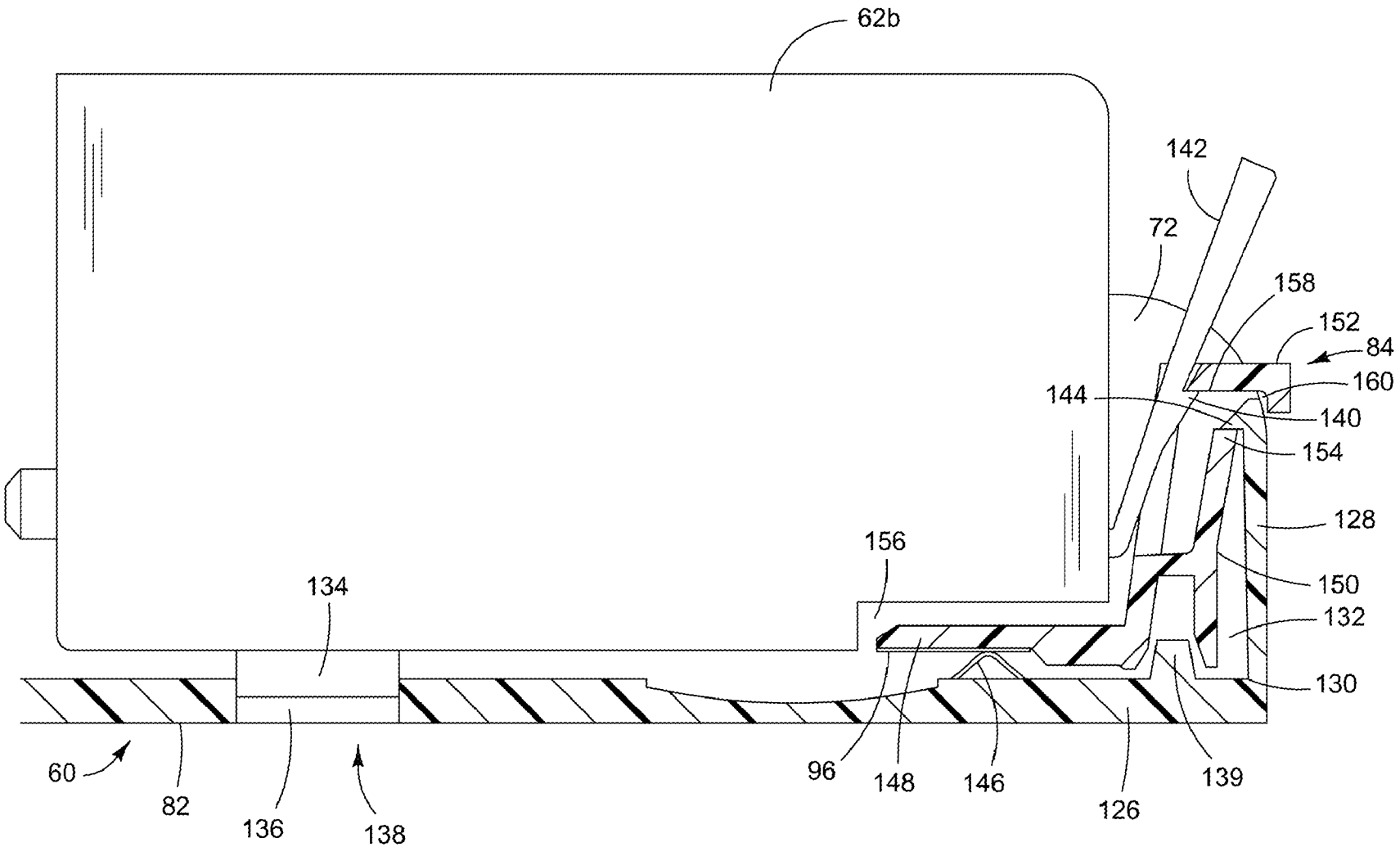
FIG. 6 is a partial side elevation section view showing one example of a new installation for a non-chipped print cartridge.

FIG. 5 is a partial side elevation section view showing the installation of a chipped cartridge 62*a* in a bay 72 in holder 60. FIG. 5 illustrates one example of a conventional installation for a chipped ink cartridge. FIG. 6 is a partial side elevation section view showing the installation of a non-chipped cartridge 62*b* in bay 72 in holder 60 with an adapter 84 or 84*a*. FIG. 6 illustrates one example of a new installation for a non-chipped ink cartridge. Referring first to FIG. 5, this section of body 82 of holder 60 is typical of each bay 72-80. Body 82 includes a floor 126 joined to a wall 128 at a junction 130, forming a front part 132 of bay 72. ("Front", "rear" and other references to spatial orientation are taken from the perspective of a user facing the printer. "Front" and "rear", for example, therefore, refer to a direction or part of the printer nearer the user and farther from the user, respectively.) An opening 134 in cartridge 62*a* and an associated opening 136 in floor 126 form a fluid interconnect 138 toward the rear of bay 72 through which ink may flow from cartridge 62*a* to a printhead or other downstream component in the printer. A stop 139 protruding from floor 126 helps properly position cartridge 62*a* in bay 72. A tab 140 on a spring arm 142 on cartridge 62*a* engages a shelf 144 on wall 128 to help secure cartridge 62*a* in position in bay 72. Contact pads (not shown) on chip 86 engage electrical connectors 146 in holder 60.

Figure 7:
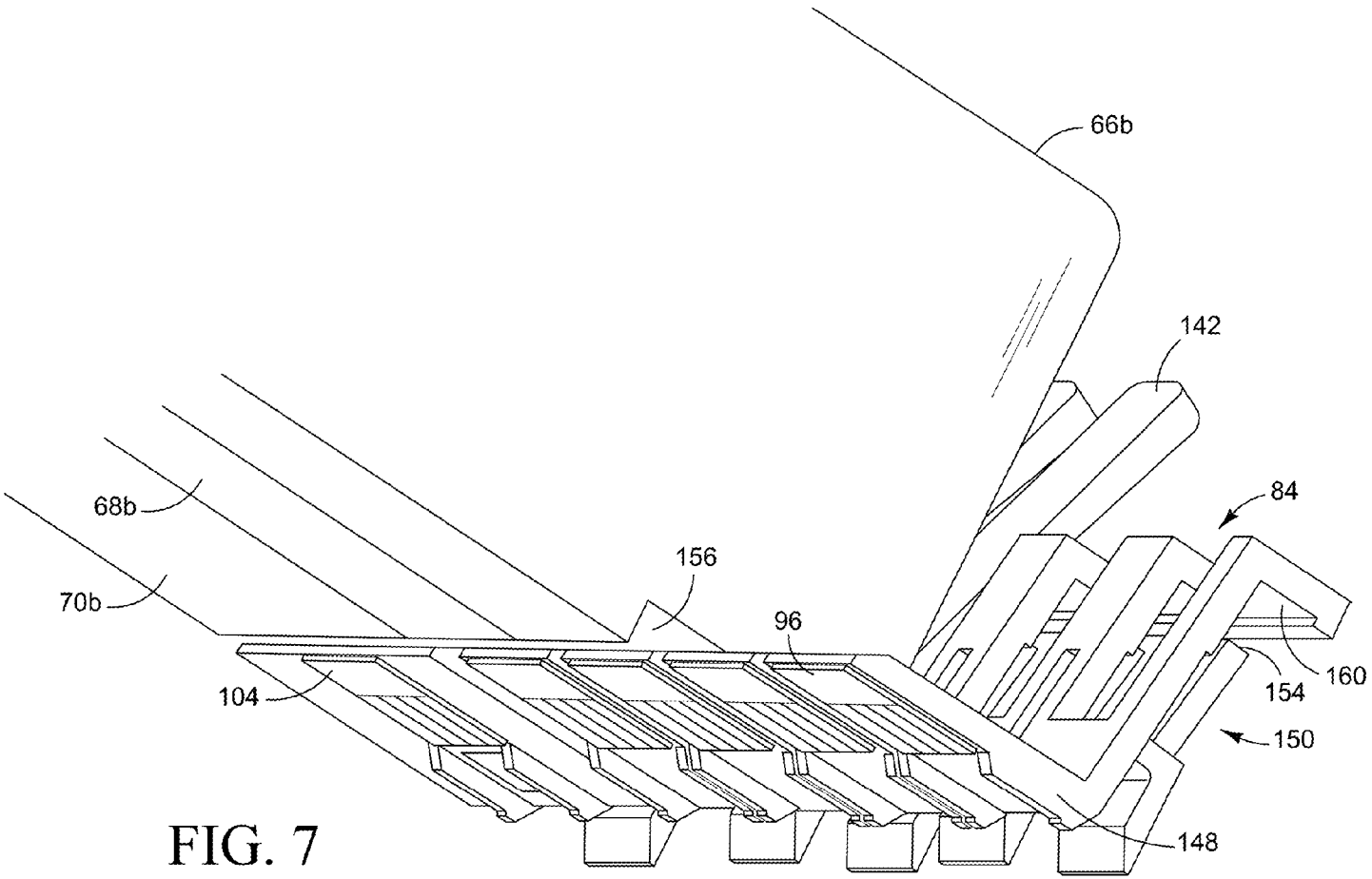
FIG. 7 is a detail perspective view of one embodiment of an adapter and non-chipped print cartridges.

The structural components of body 82 of holder 60 in FIG. 6 are the same as those shown in FIG. 5. In FIG. 6, a non-chipped cartridge 62*b* is installed in bay 72 using a group adapter 84 or an individual adapter 84*a*. For convenience, a group adapter 84 is referenced in the following description. FIG. 7 is a detail perspective view of just the adapter 84 and cartridges 66*b*, 68*b* and 70*b*. Cartridges 62*b* and 64*b* are omitted from FIG. 7 to better illustrate the structural features of adapter 84. Referring to FIGS. 6 and 7, adapter 84 includes a lower part 148 that extends rearward along floor 126 and mounts chips 96-104 at the location of chip sites 116-124, an h-shaped middle part 150 that positions adapter 84 over stop 139, and a recessed upper part 152 that clips over the top of wall 128. The top of h-shaped middle part 150 forms a tab 154 that engages shelf 144 on wall 128 (like tab 142 of chipped cartridge 62*a* in FIG. 5) to hold h-shaped middle part 150 over stop 139. Adapter 84 is thus held in the correct position in body 82 of holder 60. An L-shaped recess 156 along the bottom of each non-chipped cartridge 62*b*-70*b* accommodates space within bay 72 occupied by adapter lower part 146. Each non-chipped cartridge 62*b*-70*b* is a bit shorter than a chipped cartridge 62*a*-70*a* to accommodate space with bay 72 occupied by adapter middle part 150. Tab 140 on cartridge spring arm 142 engages a shelf 158 formed by a U-shaped recess 160 (FIG. 7) in the upper part 152 of adapter 84 to help hold cartridge 62*b* in position in body 72.

Figure 8:
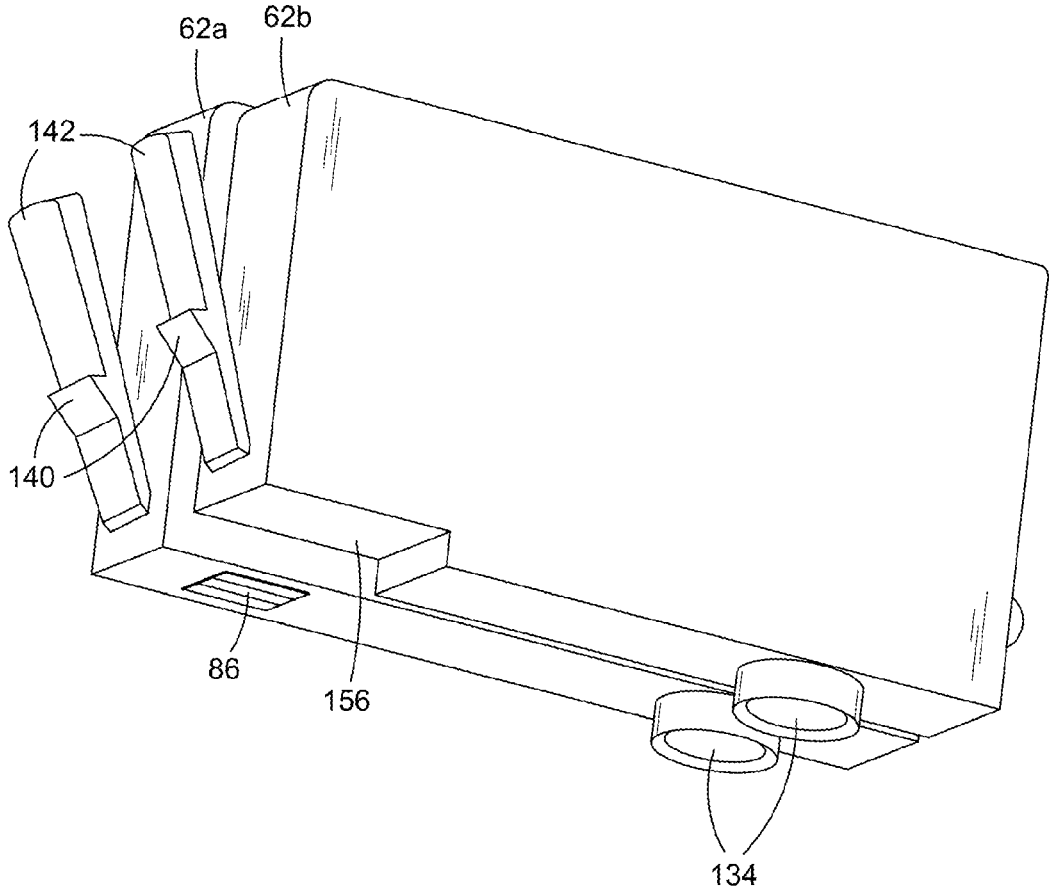
FIG. 8 is a side by side comparison of a chipped print cartridge and one embodiment of a new non-chipped print cartridge.

FIG. 8 is a side by side comparison of a chipped print cartridge 62*a* and one embodiment of a new non-chipped print cartridge 62*b*. Referring to FIG. 8, chipped cartridge 62*a* includes chip 86 and an ink port 134 disposed along a generally flat bottom surface of the cartridge. Non-chipped cartridge 62*b* also includes an ink port 134 toward the front of the cartridge. The bottom of cartridge 62*b* is recessed (L-shaped recess 160) at the rear to accommodate the lower portion 148 of adapter 84 in the holder bay (as shown in FIGS. 6 and 7). Non-chipped cartridge 62*b* is also a bit shorter than chipped cartridge 62*a* to accommodate the middle portion 150 of adapter 84 in the holder bay (as shown in FIG. 6).

As noted at the beginning of this Description, the exemplary embodiments shown in the figures and described above illustrate but do not limit the invention. Other forms, details, and embodiments may be made and implemented. Therefore, the foregoing description should not be construed to limit the scope of the invention, which is defined in the following claims.

What is claimed is:

1. A cartridge holder for holding chipped and non-chipped cartridges, comprising:

a body having a plurality of bays therein, each bay having an electrical connector associated therewith for connecting to a chip;

an adapter removably attachable to the body at a bay such that the adapter may be attached to the body and detached from the body, the adapter having a site for a chip at a location where a chip installed at the chip site is connected to the connector associated with the bay when the adapter is attached to the body; and each bay configured to hold without an adapter attached to the body at the bay, a first cartridge having a first shape and a chip thereon, and with the adapter attached to the body at the bay, a second cartridge having a second shape different from the first shape and the second cartridge not having a chip thereon.

2. The holder of claim 1, wherein the adapter comprises a single unit removably attachable to the body along all of the bays and the chip site comprises a plurality of chip sites each corresponding to one of the bays in the body.

3. The holder of claim 1, wherein the adapter comprises an adapter removably attachable to the body at only one bay and the chip site comprises a single chip site.

4. The holder of claim 1, wherein the adapter comprises a plurality of adapters each removably attachable to the body at one of the bays and each of the plurality of adapters having a site for a chip at a location where a chip installed at the chip site is connected to the connector associated with the corresponding bay when the adapter is attached to the body.

5. The holder of claim 2, further comprising a plurality of chips on the adapter, each chip positioned on the adapter at one of the chip sites.

6. The holder of claim 3, further comprising a single chip on the adapter at the single chip site.

7. The holder of claim 4, further comprising a plurality of chips each positioned on one of the adapters at the chip site.

8. The holder of claim 5, wherein each chip comprises a chip removed from a used first cartridge.

9. The holder of claim 6, wherein the chip comprises a chip removed from a used first cartridge.

10. The holder of claim 7, wherein each chip comprises a chip removed from a used first cartridge.

11. A kit for adapting a cartridge holder to hold chipped and non-chipped cartridges, the holder including a body having a plurality of bays therein, each bay configured to hold a cartridge and each bay having an electrical connector associated therewith for connecting to a chip, the kit comprising:

an adapter removably attachable to the body at a bay such that the adapter may be attached to the body and detached from the body, the adapter having a site for a chip at a location where a chip installed at the chip site is connected to the connector associated with the bay when the adapter is attached to the body;

each bay configured to hold without an adapter attached to the body at the bay, a first cartridge having a first shape and a chip thereon, and with the adapter attached to the body at the bay, a second cartridge having a second shape different from the first shape and the second cartridge not having a chip thereon; and a second cartridge having the second shape and not having a chip thereon.

12. The kit of claim 11, wherein:

the adapter comprises a single unit removably attachable to the body along all of the bays and the chip site comprises a plurality of chip sites each corresponding to one of the bays in the body; and the second cartridge comprises a plurality of second cartridges each having the second shape and each not having a chip thereon.

13. The kit of claim 11, wherein:

the adapter comprises an adapter removably attachable to the body at only one bay and the chip site comprises a single chip site; and the second cartridge comprises a single second cartridge having the second shape and not having a chip thereon.

14. The kit of claim 11, wherein:

the adapter comprises a plurality of adapters each removably attachable to the body at one of the bays and each of the plurality of adapters having a site for a chip at a location where a chip installed at the chip site is connected to the connector associated with the corresponding bay when the adapter is attached to the body; and the second cartridge comprises a plurality of second cartridges each associated with one of the adapters and each having the second shape and not having a chip thereon.

15. An adapter for replacing a set of first inkjet print cartridges each having a chip with a set of second inkjet print cartridges each not having a chip, the adapter comprising:

a first part configured to removably attach to a cartridge holder, the first part including a location for each of the second cartridges;

a second part including a plurality of chip sites each corresponding to a location for one of the second cartridges; and a plurality of substitute chips each situated at one of the chip sites, each substitute chip representing a chip on a corresponding one of the first cartridges.

16. The adapter of claim 15, wherein each substitute chip comprises a chip representing a chip on a corresponding one of the first cartridges after the first cartridge has been used in a printer.

17. The adapter of claim 15, wherein each substitute chip comprises a chip representing a chip on a corresponding one of the first cartridges before the first cartridge has been used in a printer.

18. The adapter of claim 16, wherein each substitute chip comprises a chip recycled from a corresponding one of the first cartridges.

* * * * *